US009515416B2

(12) United States Patent
Li et al.

(10) Patent No.: US 9,515,416 B2
(45) Date of Patent: Dec. 6, 2016

(54) CARD EDGE CONNECTOR WITH A RELIABLE LOCKING PIECE

(71) Applicant: FOXCONN INTERCONNECT TECHNOLOGY LIMITED, Grand Cayman (KY)

(72) Inventors: Zhuang-Xing Li, Kunshan (CN); Xue-Hai Shen, Kunshan (CN); Wen-Jun Tang, Kunshan (CN); Xue-Wu Bu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/820,967

(22) Filed: Aug. 7, 2015

(65) Prior Publication Data

US 2016/0043487 A1 Feb. 11, 2016

(30) Foreign Application Priority Data

Aug. 7, 2014 (CN) ..... 2014 1 0386008

(51) Int. Cl.
*H01R 13/633* (2006.01)
*H01R 12/70* (2011.01)
*H01R 12/72* (2011.01)

(52) U.S. Cl.
CPC ..... *H01R 13/633* (2013.01); *H01R 12/7029* (2013.01); *H01R 12/721* (2013.01)

(58) Field of Classification Search
USPC ..... 439/155, 157, 326, 328, 327, 160
See application file for complete search history.

(56) References Cited

U.S. PATENT DOCUMENTS 5,112,242 A * 5/1992 Choy ..... H01R 12/7005 439/326
5,203,714 A * 4/1993 Tuan ..... H01R 23/72 439/326
5,211,568 A * 5/1993 Yamada ..... H01R 12/7005 439/153
5,340,328 A * 8/1994 Lee ..... H01R 12/7005 439/326
5,413,497 A * 5/1995 Lwee ..... H01R 12/721 439/326
5,647,755 A * 7/1997 Hida ..... H01R 12/7005 439/157
5,820,396 A * 10/1998 Pan ..... H01R 12/7005 439/328

(Continued)

FOREIGN PATENT DOCUMENTS

CN 201142447 Y 10/2008
TW M383844 7/2010

*Primary Examiner* — Alexander Gilman
(74) *Attorney, Agent, or Firm* — Wei Te Chung; Ming Chieh Chang

(57) ABSTRACT

A card edge connector for receiving a memory card includes an insulative housing with a central slot for receiving the memory card and a plurality of terminal contacts retained in a plurality of grooves defined by the insulative housing and a retainer positioned on the housing. The retainer defines a body portion mounted on the housing, a locking portion extending into the housing from the body portion and a elastic engaging portion extending downwardly into the central slot from inner side of the body portion for steadily locking the memory card.

16 Claims, 3 Drawing Sheets

(56) References Cited

U.S. PATENT DOCUMENTS

| | | | | | |
|---|---|---|---|---|---|
| 5,980,282 | A * | 11/1999 | Cheng | H01R 12/7005 | 439/155 |
| 5,980,295 | A * | 11/1999 | Lai | H05K 7/1405 | 439/327 |
| 7,517,239 | B1 * | 4/2009 | Ju | H01R 13/6275 | 439/159 |
| 8,002,563 | B2 * | 8/2011 | Li | H01R 12/7005 | 439/157 |
| 8,007,303 | B2 * | 8/2011 | Yao | H01R 12/7005 | 439/153 |
| 8,157,576 | B2 * | 4/2012 | Fu | H01R 12/7005 | 439/153 |
| 8,535,077 | B2 * | 9/2013 | Shen | H01R 12/737 | 439/160 |
| 9,033,724 | B2 * | 5/2015 | Lai | H01R 13/6271 | 439/157 |
| 2009/0104793 | A1 * | 4/2009 | Chung | H01R 13/62988 | 439/59 |

* cited by examiner

CARD EDGE CONNECTOR WITH A RELIABLE LOCKING PIECE

BACKGROUND OF THE INVENTION

1. Field of the Invention

The present invention relates to a card edge connector, more particularly to a card edge connector with a reliable locking piece.

2. Description of Related Art

Card edge connector is widely used in computer device for receiving an electrical card such as DDR3 (Double Date Rate 3) or DDR4 (Double Date Rate 4) series of memory card. China Patent No. CN201142447Y, published on Oct. 29, 2008, discloses a similar card edge connector, and the card edge connector includes a longitudinal insulative housing, a plurality of contacts retained in the insulative housing, at least a latch rotatably mated in one end side of the insulative housing, and a retaining portion retained in another end side of the insulative housing. The insulative housing defines a central slot extending in the longitudinal direction for receiving the bottom edge of a mating electrical card. The contacts are retained in two sides of the insulative housing along the longitudinal direction and protrude into the central slot for clamping the mating electrical card, and it makes a stable electrical connection between the contacts and mating gold fingers defined in the mating electrical card. The insulative housing mates an elastic metal part in the retaining portion. And one end of the elastic metal part is retained in the insulative housing and another end defines an opening for buckling a groove defined in the side edge of the mating electrical card. And the opening could buckle or get away from the groove by the elastic force.

However, with numerous insert and pull the electrical card in and out, the elastic metal part may be useless for an unrecoverable elastic deformation. And thereby, the electrical card is unable to keep stable and hard to keep a good electrical contact with the card edge connector when the electrical card is inserted.

Hence, an improved card edge connector is required to overcome the disadvantages of the related art.

BRIEF SUMMARY OF THE INVENTION

Accordingly, the object of the present invention is to provide an electrical connector with a reliable soldering.

In order to achieve the object reminded above, a card edge connector includes a longitudinal insulative housing defining a central slot, a plurality of contacts received in the insulative housing and protruding into said central slot, at least a retainer retained at one longitudinal end of the insulative housing, the retainer defining a pair of clamping arms for retaining the retainer in the insulative housing. The retainer also includes an elastic engaging portion integrally extending therefrom, the elastic engaging portion has a latch portion protruding toward the central slot.

According to the present invention, the card edge connector defining an elastic engaging latch for fixing the mating electrical card could lock the memory card steadily.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
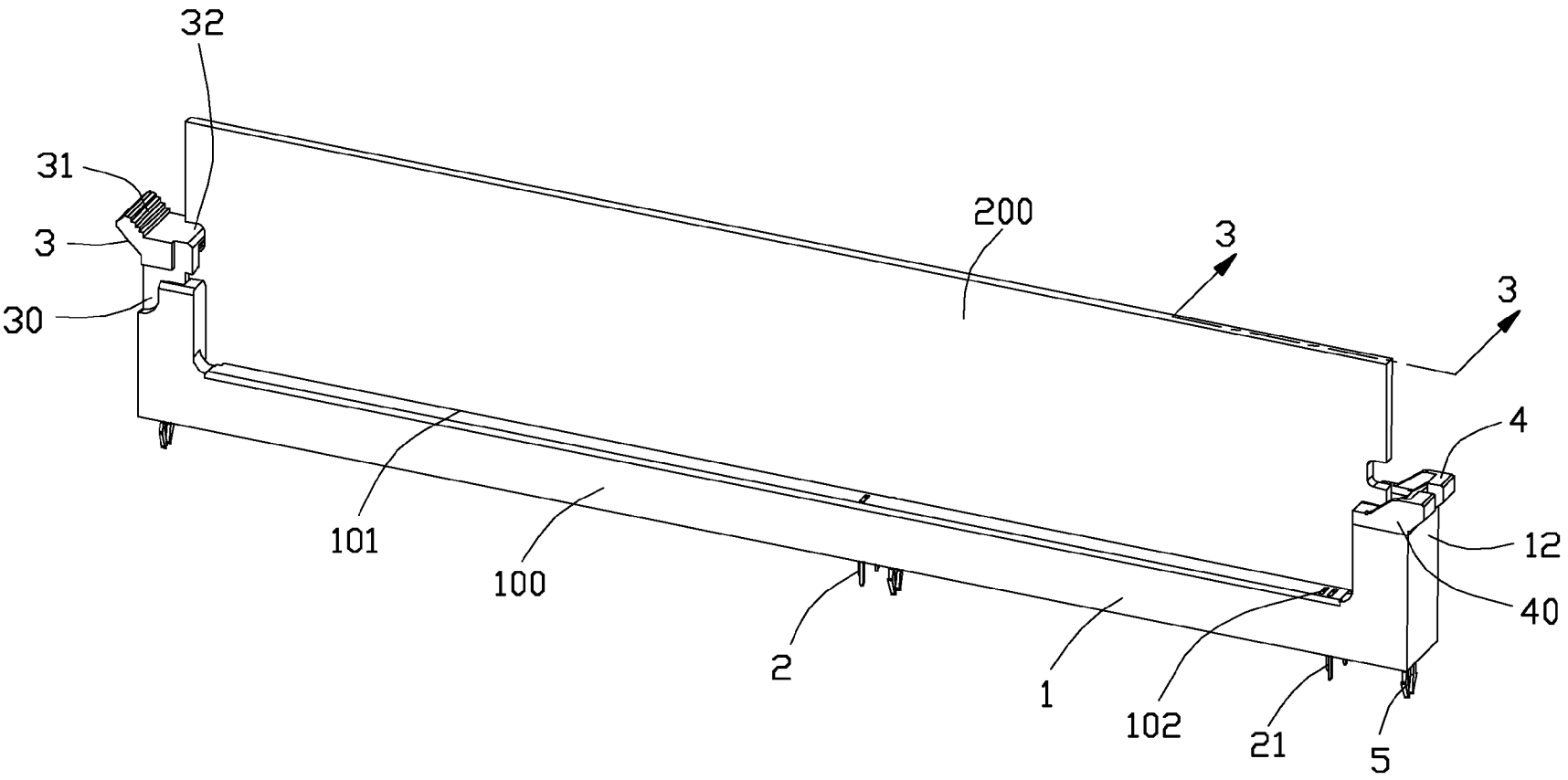
FIG. 1 is a perspective view of a card edge connector with a few of contacts according to the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
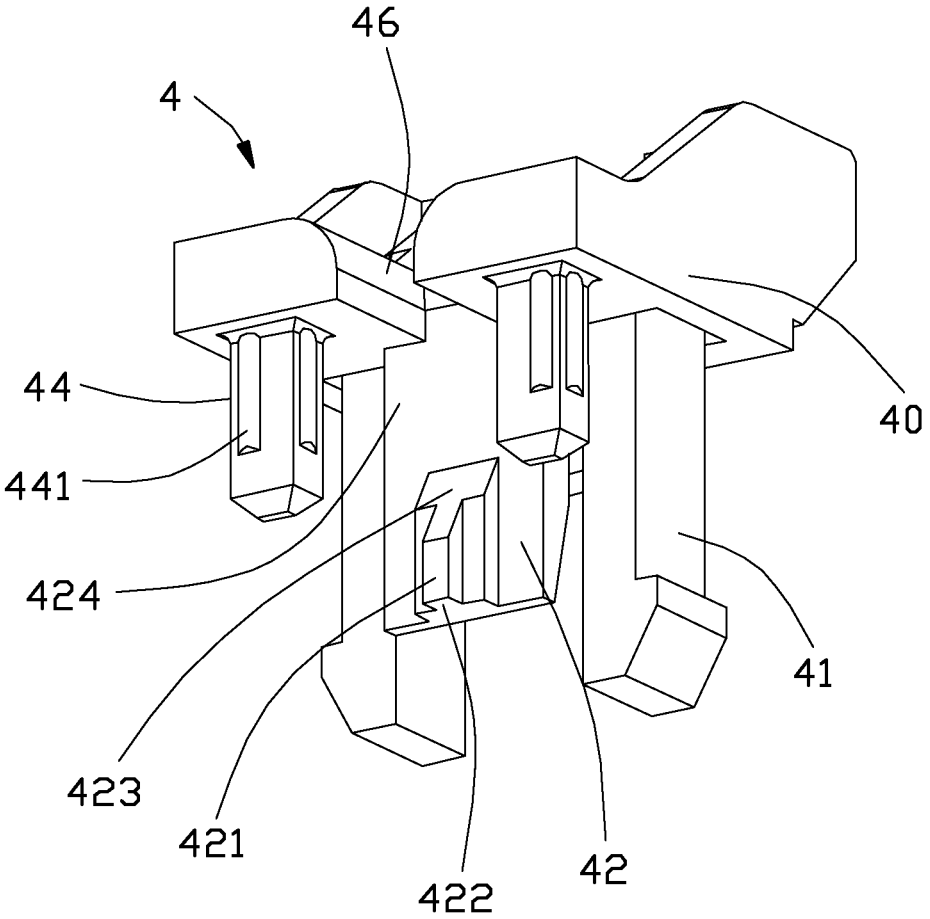
FIG. 2 is a perspective view of a retainer of the card edge connector shown in FIG. 1.
Figure 3:
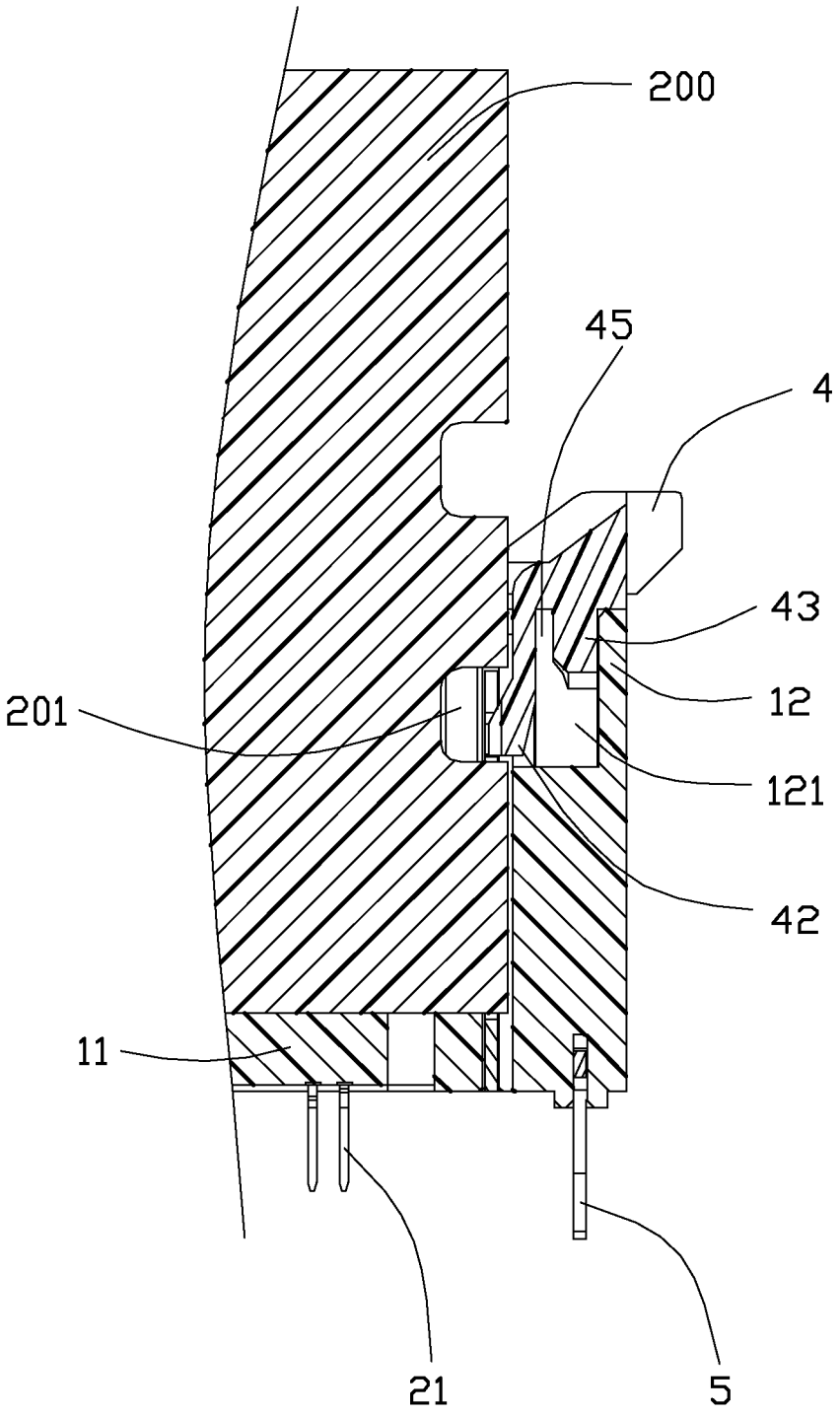
FIG. 3 is a partly cross-sectional view of the card edge connector shown in FIG. 1 along the line 3-3.

According to the present invention, a card edge connector 100 for receiving an electrical card or memory module 200 is provided which could be welded to a print circle board (not shown). The card edge connector 100 defines an insertion direction and the electrical card 200 is inserted into the card edge connector 100 therealong. Referring to FIGS. 1-3, the card edge connector 100 includes a longitudinal insulative housing 1, a plurality of contacts 2 retained in the insulative housing 1, a rotatable latch 3 mated in one end side of the insulative housing along the longitudinal direction, a retainer 4 fixed in another end side thereof and at least a hook 5 for fixing the card edge connector to the print circle board. The rotatable latch 3 and the retainer 4 clamp two end side of the electrical card 200 in the longitudinal direction respectively.

The insulative housing 1 defines a pair of longitudinal sidewalls 11 and a pair of tower portions 12 connects the both ends of the sidewalls 11 in the transverse direction. A central slot 101 is formed in the insulative housing 1 by the sidewalls 11 and the tower portions 12 for receiving a mating electrical card 200. The insulative housing 1 also defines a plurality of grooves 102 connecting the central slot 101 for receiving the contacts 2. Each of the contacts 2 has a contacting arm (not shown) protruded into the central slot 101 for an electrical contact with the electrical card 200, and a soldering portion 21 extending downwardly from the contacting arm and out of the insulative housing for an electrical communication with the mating print circle board.

The tower portions 12 is higher than the sidewalls 11. One of the tower portions 12 has a receiving opening (not shown) for receiving the rotatable latch 3. The rotatable latch 3 includes a base portion 30. The bottom side of the base portion 30 is received in the tower portion 12, and an operating portion 31 disposed at distal end of the latch 3 and a locking portion 32 disposed at opposite end of the operating portion 31. The rotatable latch 3 could be rotated to switch between an opening position and a locking position relatively to the insulative housing 1, and following the rotation, the locking portion 32 clamps or leaves a mating recess 201 of the electrical card 200.

The retainer 4 is inserted into the insulative housing 1 along the insertion direction and retained in another tower portion 12 of the insulative housing 1. The retainer 4 includes a main portion 40 covering the tower portion 12 of the insulative housing 1, a clamping arm 41 extending from the main portion 40 and mating with the insulative housing 1, an elastic engaging portion 42 extending into the central slot 101 from the main portion 40 for clamping the electrical card 200 and a stopper 43 locating at outward of the elastic engaging portion 42. The tower portion 12 has a receiving slot 121 for receiving the clamping arm 41, the elastic engaging portion 42 and stopper 43. The clamping arm 41 could clamp the receiving slot 121 for fixing the retainer 4 in the tower portion 12 of the insulative housing 1.

The elastic engaging portion 42 defines a step-shaped latch portion 421 protruding into the central slot in the end side of the elastic engaging portion 42. When the electrical card 200 is inserted into the card edge connector 100, the latch portion 421 presses the recess 201 of the electrical card 200 with a small contact surface which could increase the force for pressing. The main portion 40 of the retainer 4 also defines a channel for the electrical card 200 passing through. In a top view along the insertion direction, the elastic engaging portion 42 is extending across the channel 46, and the latch portion 421 is aligned with the channel 46.

According to the present invention, it could define a width direction which is vertical to the longitudinal direction. The latch portion 421 has a contact surface 422 for contacting the electrical card 200. The contact surface 422 is T-shaped and vertical to the insertion direction for engaging with the electrical card 200 in the insertion direction. The area of the contact surface 422 could be formed in different size as requirement for a best pressing force. The stopper 43 and the elastic engaging portion 42 extend in the same direction and form a gap 45 therebetween. The gap 45 provides a reserved space for the elastic movement of the elastic engaging portion 42 and prevents any damages from an over elastic deformation. According to the requirement, the elastic engaging portion 42 could be formed in different size for mating with different locking portions of different mating cards. The width of the latch portion 421 could also adjust as the requirement. The retainer is simple and easy to adjust.

The elastic engaging portion 42 defines a simple and flat-liked connecting part 424. The clamping arm 41 protrudes into the insulative housing 1 from the main portion 40. The retainer 4 has a positioning portion 44 extending into the insulative housing. The positioning portion 44 defines several ribs 441 engaging with the insulative housing, and the ribs locate in different sides of the positioning portion 44 respectively. In the longitudinal direction, the elastic engaging portion 42 locates between the clamping arm 41 and the positioning portion 44 for a balanced retaining force between the retainer 4 and the insulative housing 1. Thereby, it could be easy to assemble.

While the electrical card 200 is being inserted, the elastic engaging portion 42 retracts into the gap 45, and until the electrical card 200 is inserted, the latch portion 421 gets into the recess 201 and the contact surface 422 presses the bottom surface of the recess 201 and the retainer is in locking station. The latch portion 421 defines an inclined guiding surface 423 formed at a top end thereof opposite to the contact surface 422 for guiding the electrical card 200 be inserted into the central slot 101. The elastic engaging portion 42 extends along the insertion direction and it makes the resistance force between the electrical card 200 and the retainer 4 increases along the process of the electrical card 200 being inserted. At the beginning of pulling out the electrical card 200, the resistance force between the electrical card 200 and the retainer 4 becomes the largest, and it makes electrical card 200 locked reliably.

Compared with the mentioned prior art which discloses the retainer having a simple planar structure with the fixing section at the lower end for securing to the housing and the outwardly moveable latching section around the upper end for locking the memory module in a guidable manner, the instant invention essentially uses the complicated structure having on an inner side the elastic engaging portion 42 with an immovable upper end which is not for securing to the housing 1 but indirectly connected to a pair of clamping arms 41 which are secured to the housing 1 and located on an outer side of the elastic engaging portion 42. Notably, the outward deflection essentially occurs around the lower portion of the elastic engaging portion 42 during downwardly loading the memory module 200 into the housing 1, and the upper section of the elastic engaging portion 42 is essentially immovable during loading/unloading the memory module 200, thus providing a reliable guiding operation during loading/unloading advantageously. In opposite, in the prior art the outward deflection of the upper region above the latch section of the retainer may result in an unreliable loading/unloading situation disadvantageously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector including:

a longitudinal insulative housing defining a central slot;

a plurality of contacts received in the insulative housing and protruding into said central slot;

at least a retainer retained at one longitudinal end of the insulative housing, the retainer defining a pair of clamping arms for retaining the retainer in the insulative housing;

wherein the retainer also includes an elastic engaging portion integrally extending therefrom, the elastic engaging portion has a latch portion protruding toward the central slot;

wherein the latch portion is formed at a free end of the elastic engaging portion and defines a contact surface formed at a bottom side thereof, the latch portion is step-liked, and the contact surface is T-shaped.

2. The card edge connector as described in claim 1, wherein the latch portion defines an inclined guiding surface formed at a top end thereof opposite to the contact surface.

3. The card edge connector as described in claim 1, wherein the retainer defines at least a stopper locating at outward of the elastic engaging portion, the stopper and the elastic engaging portion extend in the same direction and form a gap therebetween.

4. A card edge connector for insertion of an electrical card including:

a longitudinal insulative housing defining a central slot extending in a longitudinal direction for receiving said electrical card and a pair of tower portions located at two longitudinal sides of the central slot;

a plurality of contacts received in the insulative housing and protruding into said central slot for contacting with said electrical card;

a rotatable latch coupled to one of the tower portions for ejecting or latching one side of the electrical card; and a retainer retained at another one of the tower portions;

wherein the retainer defines a pair of clamping arms for retaining the retainer in the insulative housing and an elastic engaging portion defining a latch portion protruding toward the central slot for latching another side of the electrical card;

wherein the retainer further defines a stopper received into a receiving slot of said tower portion and locating at an outer side of the elastic engaging portion in said longitudinal direction for preventing said elastic engaging portion from over-deformation.

5. The card edge connector as described in claim 4, wherein the retainer includes a main portion covering said another tower portion, the clamping arms extend downwardly from the main portion and are received in said receiving slot of the tower portion, the elastic engaging portion is located at inner sides of the clamping portions in said longitudinal direction and located between said clamping arms in a transverse direction perpendicular to said longitudinal direction.

6. The card edge connector as described in claim 5, wherein the main portion of the retainer also defines a channel for the electrical card passing through, and in a top view along an insertion direction, the elastic engaging portion is extending across the channel, and the latch portion is aligned with the channel.

7. The card edge connector as described in claim 5, wherein the retainer has at least a positioning portion extending along the same direction of the clamping arm, and the elastic engaging portion locates between the positioning portion and the clamping arm in the longitudinal direction.

8. The card edge connector as described in claim 7, wherein the position portion defines several ribs set in different sides of the position portion to engage with the insulative housing.

9. An electrical connector for receiving a memory module, comprising:

an insulative housing defining a receiving slot extending along a longitudinal direction, and two towers at two opposite ends in said longitudinal direction, respectively;

two rows of terminals disposed in the housing and located by two sides of the receiving slot in a transverse direction perpendicular to said longitudinal direction, respectively;

an ejector pivotally mounted on one of said two towers;

a retainer immovably mounted on the other of said two towers in a vertical direction perpendicular to both said longitudinal direction and said transverse direction, and including a main portion located around a top face of the corresponding tower, an immovable clamping arm downward extending from the main portion, an elastic engaging portion extending from the main portion and spaced and independent from the clamping arm with a latching section thereon for latching with the memory module; wherein said elastic engaging portion is essentially deflectable and cantilevered with a root at thereof an upper end which is connected to the main portion so as to assure a reliable condition during loading/unloading the memory module with regard to the housing; wherein the latching section defines a stepped structure in the transverse direction.

10. The electrical connector as claimed in claim 9, wherein said latching section is equipped with an upward oblique guiding surface.

11. The electrical connector as claimed in claim 10, wherein said latch section is located around a lower end of the elastic engaging portion.

12. The electrical connector as claimed in claim 11, wherein an outer surface of the elastic engaging portion is configured with a wedged shape for complying with outward deflection of the elastic engaging portion.

13. The electrical connector as claimed in claim 9, wherein the tower forms an end wall with an inner surface adapted to facing a lower portion of a side edge of the memory module when the memory module is received within the housing, and an inner face of the elastic engaging portion is essentially coplanar with the inner surface of the end wall to face a portion of the side edge of the memory module other than said lower portion.

14. The electrical connector as claimed in claim 9, wherein said retainer further includes a positioning portion downwardly extending from the main portion to secure to the housing.

15. The electrical connector as claimed in claim 14, wherein viewed in the transverse direction, said the elastic engaging portion is essentially located between the clamping arm and the positioning portion in the longitudinal direction.

16. The electrical connector as claimed in claim 9, wherein said stepped structure forms a protruding portion located at a centerline of said latching section.

* * * * *